United States Patent [19]

Myers

[11] Patent Number: 4,552,430

[45] Date of Patent: Nov. 12, 1985

[54] CONNECTOR HEAD FOR ELECTRIC TERMINAL BOX

[75] Inventor: Stephanie A. Myers, Santa Ana, Calif.

[73] Assignee: Myers Electric Products, Inc., Montebello, Calif.

[21] Appl. No.: 429,534

[22] Filed: Sep. 30, 1982

[51] Int. Cl.[4] ..... H01R 13/11

[52] U.S. Cl. ..... 339/242; 339/245

[58] Field of Search ..... 339/242 R, 31 R, 32 R, 339/33 R, 149 R, 17 LC, 143, 245, 198 J, 220 R, 119 R

[56] References Cited

U.S. PATENT DOCUMENTS

| | | | |
|---|---|---|---|
| 1,422,910 | 7/1922 | Young | 339/198 J |
| 2,728,002 | 12/1955 | Turner | 339/198 J |
| 4,329,008 | 5/1982 | Braginetz | 339/17 LC X |
| 4,415,217 | 11/1983 | Clabburn et al. | 339/DIG. 1 |

FOREIGN PATENT DOCUMENTS

| | | | |
|---|---|---|---|
| 923575 | 3/1973 | Canada | 339/242 |
| 1013047 | 6/1977 | Canada | 339/242 |
| 528831 | 7/1931 | Fed. Rep. of Germany | 339/198 J |
| 1220001 | 6/1966 | Fed. Rep. of Germany | 339/242 |

*Primary Examiner*—William R. Briggs

*Attorney, Agent, or Firm*—Howard L. Johnson

[57] ABSTRACT

A connector unit and a terminal box containing such units for individually coupling a plurality of closely grouped electrical cables to circuit breakers in the box in such manner that the cables can take off in a different direction without bending the cables. Unit consists of metal elbow with insertion lance at one end and cable coupling means at other end. May have second 90° bend and also be shrink sheath insulated after installation.

2 Claims, 4 Drawing Figures

CONNECTOR HEAD FOR ELECTRIC TERMINAL BOX

BACKGROUND OF THE INVENTION

In making connections to a terminal box such as used to service a shop, residence or mobile home, a plurality of electric lines or cables (sometimes carrying reduced voltage from that of the incoming service line) are individually coupled to a connector box's bank of circuit breakers. The cables are then bent in order to take them off in another direction through an aperture in the top or bottom of the box. If the bending is not done in a fairly broad arc, it may crack or break the insulation of the cable, sometimes immediately but often later upon aging. Even though the bared wire does not directly touch a conductor at the time of rupture, its presence may become more dangerous later when combustable gas may leak or accumulate into the box, since a spark to the immediate environment (sometimes from lightening) may short the current of the exposed line and flare out to consume a transformer plus the rest of the installation.

A remedy to this problem is sought by promulgation of more stringent electrical code requirements which prescribe the minimum radius for such cable bends. The initial result of new regulations may be to compell larger size boxes in future construction. However this raises a more difficult problem in attempting to make alterations of in-place installations where it becomes impractical to try to enlarge the box size to meet a 5 to 7 times radius for a safe bend; the result may have to be a completely new assembly.

STATEMENT OF THE INVENTION

Accordingly it is an object to provide a coupling attachment or connector head for joining an electric take-off cable to a connector post, wherein the take-off involves a change of direction of the take-off line(s) but without the take-off cable itself being required to be bent. Such unit comprises an elbow-shaped connector head having an insertion lance adapted for coupling to an attachment post of a terminal or outlet box and its distal end provided with means for quick coupling to the live end of an otherwise insulated cable. A clutch of such units may individually be formed with different insertion lengths and with more than one bend so that a plurality of take-off cables may be installed to lie essentially parallel to each other within the box but in different planes and without pressing each other.

DETAILED DESCRIPTION

Figures 1, 2, 3, 4:
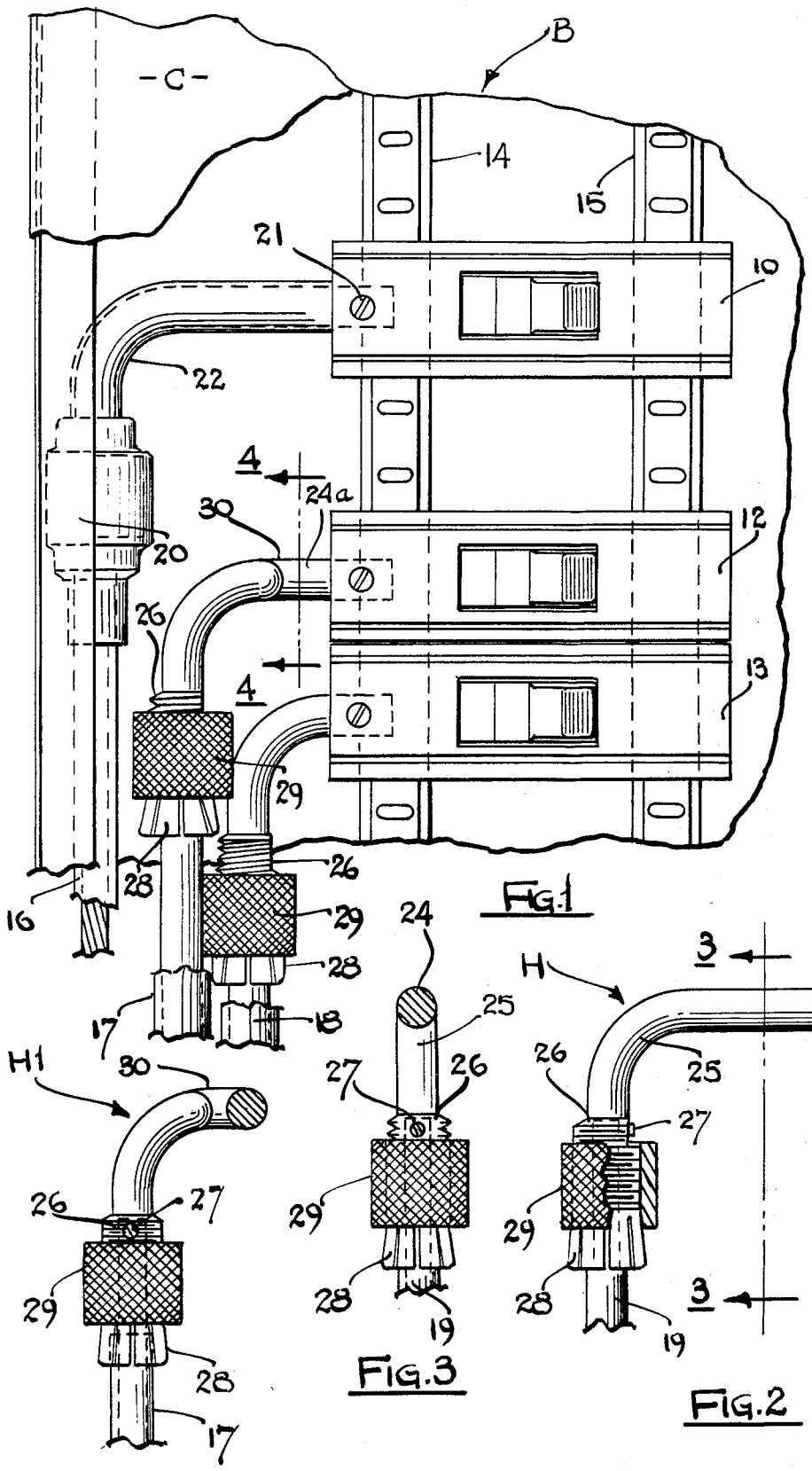
FIG. 1 is an elevational view of a connector box with the cover broken away, showing circuit breakers individually connected to a similar number of the present connector heads with the connector head at the left being encased in shrink insulation.
FIG. 2 is a side elevational view of a connector head, partly broken away.
FIG. 3 is a transverse sectional view of a connector head taken along line 3—3 of FIG. 2.
FIG. 4 is a transverse sectional view taken along line 4—4 of FIG. 1.

FIG. 1 shows a terminal box B with cover C and a bank of circuit breakers 10, 12, 13 secured to vertical mounting brackets 14, 15. It will be seen that outgoing electric cables such as 16, 17, 18 have to be taken off from the left end of the circuit breakers to a box bottom outlet (not shown) by passage along a relatively narrow channel 20. Accordingly, the several take-off cables (in addition to the problem of getting them to bend 90°) may have to be laterally offset (transverse to the plane of the drawing) as well as outwardly displaced (from the drawing plane) in order to provide each one a separate "passage". This may be done for terminally exposed portions by encapsulation with "shrink" insulation provided by "mylar" plastic sheets or tubing 22.

As seen in FIG. 2, the configured rod or connector head H is formed with an insertion end or lance 24 which projects from an elbow or bend 25 and may have a flattened end 23 for engagement by a retention screw 21, typically the entire head being made of metal for its electrical conducting properties. In the other direction or distally, the conductor/connector has a tubular, open-ended, externally threaded length 26 having a set screw 27 for engaging the end of a wire or cable 19 inserted from the open bottom. The threaded length 26 terminates in a collet-like ring of engaging prongs or fingers 28 which may be drawn together (against an inserted cable 19) by an externally knurled, internally threaded sleeve 29. In the case of the connector head H1 of FIG. 4, there is a linear section followed by a second bend 30 prior to the insertion end 24*a*. so as to outset the cable 18 and its connections 26–29 in relation to the parallel cable 17. After such installation is made, the several exposed elements can be coated or wrapped with insulation coating such as "mylar" sheet plastic, which in addition, can be heat shrunk so as to conform to the shape of the covered structure and at the same time sealing it, thus preventing arcing and the like.

The elbow 25 and also the second bend 30 are typified by 90° bends but this is not a limitation, either or both can be acute or obtuse.

I claim:

1. A generally elongated terminal box housing a plurality of transversely disposed, electrical conductors such as circuit breakers located side by side, each with a mutually adjacent, inner end spaced inward from an opposing longitudinal wall of the box so as jointly with said longitudinal wall to define a longitudinal channel therealong leading to an end outlet of said box, said plurality of conductors each being coupled to one of a group of electrically conductive, elbow-shaped connector heads, each connector head being formed with one arm bearing an insertion lance having means for coupling to one of said conductors adjacent said inner end, and a distant arm encased in a sheath of insulation, being disposed in said channel and having terminal coupling means for attachment to an individual cable extendable through said end outlet, the distant arms of said connector heads being thus disposable longitudinally along said channel.

2. A terminal box according to claim 1 wherein at least one of said connector heads has its terminal coupling means comprising a circumferentially projecting ring of cable-engaging prongs plus a rotatable, internally threaded sleeve matingly threaded upon said head and positioned upon threaded axial displacement to frictionally overlie said prings so as to draw them together in encircling engagement with an inserted cable end.

* * * * *